US007182019B2

(12) United States Patent
Cutcher et al.

(10) Patent No.: US 7,182,019 B2
(45) Date of Patent: Feb. 27, 2007

(54) SCREEN PRINTING APPARATUS

(75) Inventors: Thomas V. Cutcher, Petersburg, MI (US); Bien T. Bui, Howell, MI (US); Eric F. J. M. van der Meulen, Wixom, MI (US)

(73) Assignee: Exatec, LLC, Wixom, MI (US)

( * ) Notice: Subject to any disclaimer, the term of this patent is extended or adjusted under 35 U.S.C. 154(b) by 40 days.

(21) Appl. No.: 11/041,545

(22) Filed: Jan. 24, 2005

(65) Prior Publication Data

US 2005/0160927 A1 Jul. 28, 2005

Related U.S. Application Data

(60) Provisional application No. 60/539,050, filed on Jan. 23, 2004.

(51) Int. Cl.
*B41F 15/30* (2006.01)
*B41F 15/46* (2006.01)

(52) U.S. Cl. ..... 101/123; 101/127.1

(58) Field of Classification Search ..... 101/129, 101/123

See application file for complete search history.

(56) References Cited

U.S. PATENT DOCUMENTS

| | | | |
|---|---|---|---|
| 2,347,022 A | 4/1944 | Austin | |
| 2,818,803 A | 1/1958 | Levorson | |
| 4,184,427 A | 1/1980 | Bubley et al. | |
| 4,381,706 A | 5/1983 | Harpold | |
| 5,339,732 A | 8/1994 | Peterlini et al. | |
| 5,685,221 A | 11/1997 | Newman | |
| 5,743,182 A | 4/1998 | Kobayashi et al. | |
| 5,802,425 A | 9/1998 | Kavolius et al. | |
| 6,041,702 A | 3/2000 | Ichikawa et al. | |
| 6,138,560 A | 10/2000 | Chen | |
| 6,494,133 B2 * | 12/2002 | Ooe | 101/123 |
| 6,698,345 B2 | 3/2004 | Cutcher | |
| 6,776,100 B2 | 8/2004 | Cutcher | |
| 6,834,582 B2 | 12/2004 | Cutcher | |
| 2002/0195007 A1 | 12/2002 | Sano et al. | |

FOREIGN PATENT DOCUMENTS

| | | |
|---|---|---|
| DE | 20018616 U1 | 2/2001 |
| FR | 2515113 | 4/1983 |
| JP | 60131246 | 7/1985 |
| JP | 360210454 | * 10/1985 |

(Continued)

*Primary Examiner*—Judy Nguyen
*Assistant Examiner*—Marissa Ferguson-Samreth
(74) *Attorney, Agent, or Firm*—Brinks Hofer Gilson & Lione

(57) ABSTRACT

A screen printing apparatus for printing images onto a three dimensional surface of a substrate. The apparatus includes a screen formed of a flexible mesh material and having porous image portions that allows passage of a printing medium through it. A shaping assembly including a plurality of shapers that are movable between retracted and extended positions. In their extended positions, the shapers are engaged with the screen assembly and generally cause screen to generally conform to the three dimensional surface of the substrate. A squeegee, that is flexible and conformable to the three dimensional surface, is drawn along screen and forces at least some of the printing medium through the porous portion of the screen and onto the three dimensional surface.

30 Claims, 13 Drawing Sheets

FOREIGN PATENT DOCUMENTS

| | | |
|---|---|---|
| JP | 01232192 | 9/1989 |
| JP | 06053737 | 2/1994 |
| JP | 11289148 | 10/1999 |
| JP | 2000-318120 | 11/2000 |
| RU | 1773733 | 11/1992 |

* cited by examiner

SCREEN PRINTING APPARATUS

CROSS REFERENCE TO RELATED APPLICATION

This application claims the benefit of provisional application 60/539,050, filed Jan. 23, 2004.

BACKGROUND

1. Field of the Invention

The present invention generally relates to screen printing. More specifically, the invention relates to a screen printing apparatus for printing on three dimensional surfaces.

2. Description of Related Art

Screen printing is a versatile printing process that can be used to print images on a variety of substrates. Some of the more common substrates include fabrics, metals, glass, plastics, paper and paperboard, and some common products from the screen printing industry include clothing, glass and plastic bottles, labels, decals, signs, electronic circuit boards and windows. One particular application in the automotive industry to which screen printing has been applied is the applying of masks around the border of automotive windows.

As suggested by the above listing of products, one advantage of screen printing is that machines can be used to print on substrate having a variety of shapes, thicknesses and sizes. As a result of the development of automated and rotary screen printing machines, improved dryers, and UV curable inks, the utilization of screen printing has increased because of the simplicity of the application process. A wide range of inks and dyes can be used in screen printing. (For convenience, hereafter only the term "ink" is used.)

A machine for carrying out screen printing may be of a single or multiple table design, the latter often being seen as a rotary table style of machine. Generally, the machine includes as its primary components a screen, as substrate support, a squeegee and a mechanism for drawing the squeegee across the screen. As further mentioned below, the machine might also include a flood bar as well as a mechanism for dispensing ink onto the screen.

The screen is a porous mesh stretched tightly in a frame made of wood or metal. In order to assure proper dispensing of the ink through the mesh, proper tension on the mesh, via the frame, is required. The mesh itself is constructed of a porous fabric or stainless steel. A stencil is produced on the mesh (by either a manual or photochemical process) to define the image that is to be printed on the substrate.

After the substrate has been loaded into the machine, ink is applied onto the top of the screen and may be spread across the screen by the flood bar. With the screen being held down onto the substrate, the squeegee is drawn across the screen, applying pressure and thereby forcing the mesh to the substrate and the ink through the openings of the mesh in the areas where no stencil is applied. As a result, ink is transferred to the substrate according to the image defined by the stencil.

Many factors contribute to the quality of the image transferred to the substrate. One factor relating to the amount of ink transferred through the screen is the diameter and thread count of the thread forming the mesh. Regarding the squeegee, the hold angle, pressure, draw speed, size, hardness/durometer and material composition are all factors. While squeegee blades have typically been made from various rubbers, polyurethane has recently become one of the materials of choice.

Screen printing machines themselves are generally known to be of three basic varieties. The most used variety is the flat bed screen printing machine. Generally, in a flat bed machine a single printing station exists and the squeegee is draw across the screen, which is being held down on flat substrate. Another type of printing machine is the cylinder screen printing machine. With such a machine, the substrate is laid out in a cylindrical shape beneath a flat screen. The substrate is rotated while the screen is translated past the squeegee in order to imprint the image on the substrate. A third type of screen printing machine is the rotary machine. In this latter type of machine, a series of flat beds are provided around an indexing table and the beds are successively rotated through a loading station where a substrate is loaded onto the bed, a printing station where a screen is laid over the substrate and a squeegee drawn thereacross, and a drying station where drying or curing of the ink occurs, and a take-out station where the substrate now containing the printed image is removed from the machine.

As seen from the above, machines and components exist for screen printing images onto flat and cylindrical substrates. These technologies are well developed and result in high quality images being printed on the substrates. However, as the shapes of the substrates vary into more complex three dimensional shapes, such as those associated with automotive windows, the ability of these prior types of machines to lend themselves to the printing on three dimensional substrates is limited. Substrates having a multiplicity of curvatures across its surface are therefore a unique problem in the industry.

One problem with printing on such surfaces is maintaining the proper tension in the screen and holding the screen at a proper off-contact distance from the substrate. "Off-contact", as that term is known in the industry, is the distance by which the mesh of the screen is held away from the substrate immediately prior to and after the squeegee is drawn thereover, the squeegee forcing the mesh into contact with the substrate. Proper off-contact distances allows for precise and highly detailed images to be applied. Another problem associated with printing on multi-curvature, three dimensional surfaces is maintaining a consistent pressure across the length of the squeegee itself.

In view of the above, it is apparent that there exists a need for a screen printing apparatus or machine specifically adapted for printing on complex three dimensional surfaces.

SUMMARY

In satisfying the above need, as well as overcoming the enumerated drawbacks and other limitations of the related art, the present invention provides a screen printing apparatus for printing images onto three dimensional surfaces, e.g., automotive windows. The screen printing apparatus of the invention includes a machine frame that receives a fixture defining at least one support surface. The support surface supports the material defining the three dimensional surface to be printed upon.

A screen assembly, generally located above the three dimensional surface, includes a screen and a screen frame. The screen itself is formed of a flexible mesh material, a portion of which is porous so as to allow passage of a printing medium, such as ink, therethrough. Located about the perimeter of the screen, the screen frame supports the screen in a generally planar orientation.

A frame shaping assembly engages and manipulates the screen frame so as to generally conform one or more of the sides of the frame to assist in tensioning and shaping the screen.

A screen shaper assembly is also supported by the machine frame and located in a position wherein the screen assembly is located between the fixture and the screen shaper assembly. The screen shaper assembly includes a plurality of screen shapers, each being selectively movable between retracted and extended positions. At least some of the screen shapers are selectively moveable independently of others. In their retracted positions, the screen shapers are disengaged from the screen assembly. In their extended positions, the screen shapers are engaged with the screen. By controlling the screen shapers, the screen can be caused to generally conform to the three dimensional surface at the proper off-contact dimension.

A flexible squeegee, so as to be able to conform to the three dimensional surface, is supported and drawn by a mechanism across and in contact with the screen. This forces at least some of the printing medium through the porous portion of the screen and onto the three dimensional surface. As the squeegee is drawn across the screen, the squeegee flexes with the contour of the substrate and the shapers are selectively raised and lowered so as to allow the squeegee to pass uninterruptedly over the surface of the screen.

Further objects, features and advantages of this invention will become readily apparent to persons skilled in the art after a review of the following description, with reference to the drawings and claims that are appended to and form a part of this specification.

DETAILED DESCRIPTION

Figure 1:
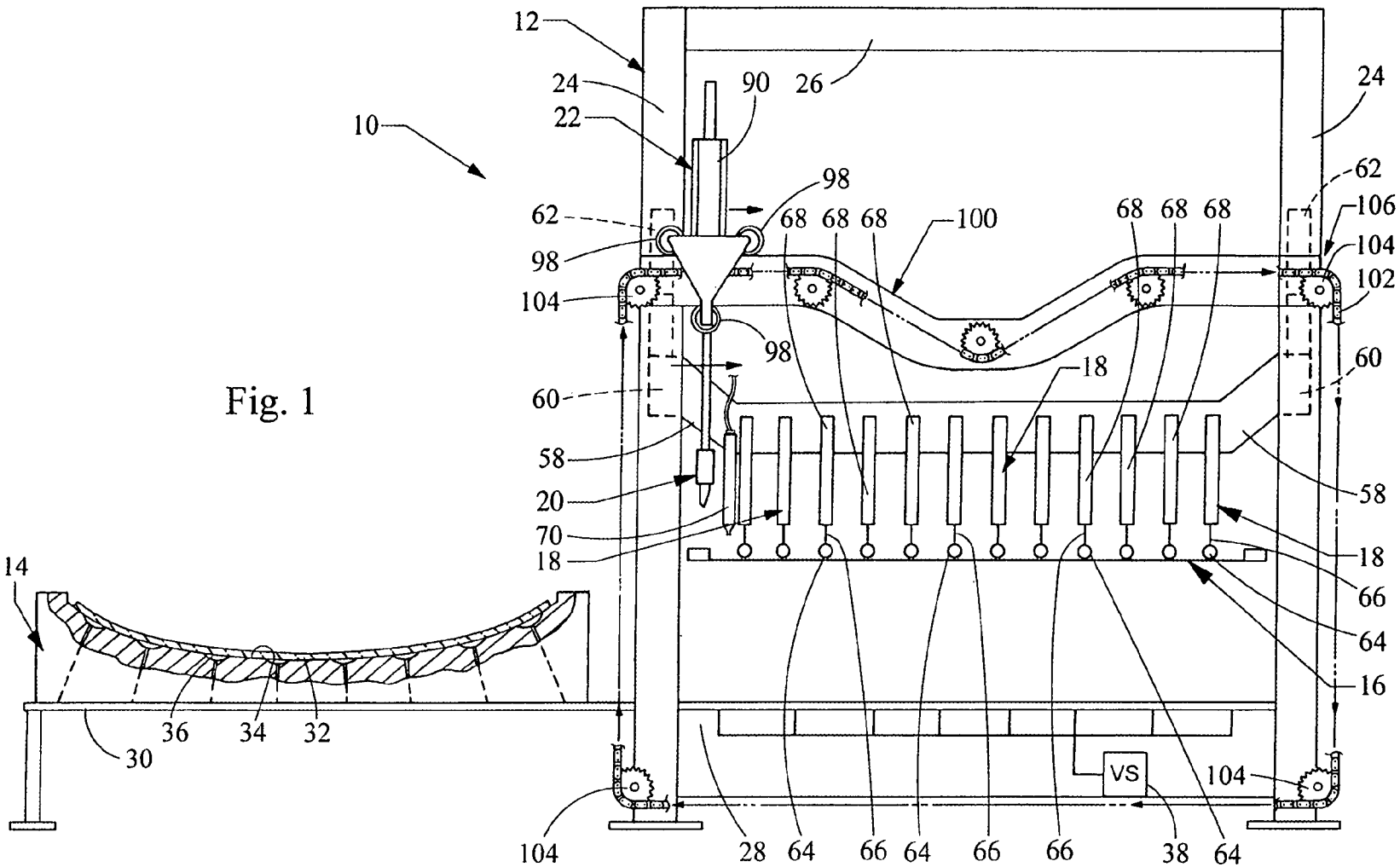
FIG. 1 is a side elevational view of screen printing machine embodying the principles of the present invention with the screen shaper assembly and screen assembly in an unconformed orientation.

Referring now to the drawings, a screen printing apparatus or machine embodying the principles of the present invention is illustrated therein and generally designated at 10. As its primary components, the machine 10 includes a frame 12, a substrate fixture 14, a screen assembly 16, various means for tensioning and shaping the screen assembly, a squeegee assembly 20 and a mechanism for conforming and drawing 22 the squeegee assembly 20 across the screen assembly 16.

The machine frame 12 is constructed with a plurality of upright support posts 24, between which extend cross-braces 26. The frame 12 further includes a bed 28 upon which the substrate fixture 14 rides via conventional methods known in the industry. For example, the substrate fixture 14 is illustrated as being slidable along rails 30, or other means, between a position generally within the machine frame 12, where actual printing takes place (as shown in FIG. 2), and a position generally outside of the frame 12, where a substrate, designated at 32, may be loaded onto the fixture 14 or removed therefrom after printing (as shown in FIG. 1).

As mentioned above, the machine 10 of the present invention is capable of screen printing onto complex three dimensional shapes. Accordingly, a substrate 32 as used with the machine 10 defines this shape. As illustrated, the substrate 32 is generally bowl shaped with the surface to be printed upon defining the concavity of the shape. Obviously, this shape is presented only for illustrative purposes and is not intended to limit the application of the present invention in any way since the machine 10 can also print on flat two dimensional surfaces, simple curves and convex shapes as well.

The substrate 32 is received within a cavity 34, defined in the fixture 14, that corresponds with the shape of the substrate 32. To secure the substrate 32 within the cavity 34 a series of vacuum cups 36 are provided about the surface defining the cavity 34. The vacuum cups 36 are in turn coupled to a vacuum source 38 that, when actuated, draws a vacuum via the interior of the vacuum cups and exerts a holding force on the substrate 32 in contact therewith. The fixture could have elevated surface portions surrounding the substrate cavity to provide off-contact. Features to hold or secure the screen relative to the fixture during the print cycle, such as vacuum cups or other means may be incorporated in the fixture.

Figure 2:
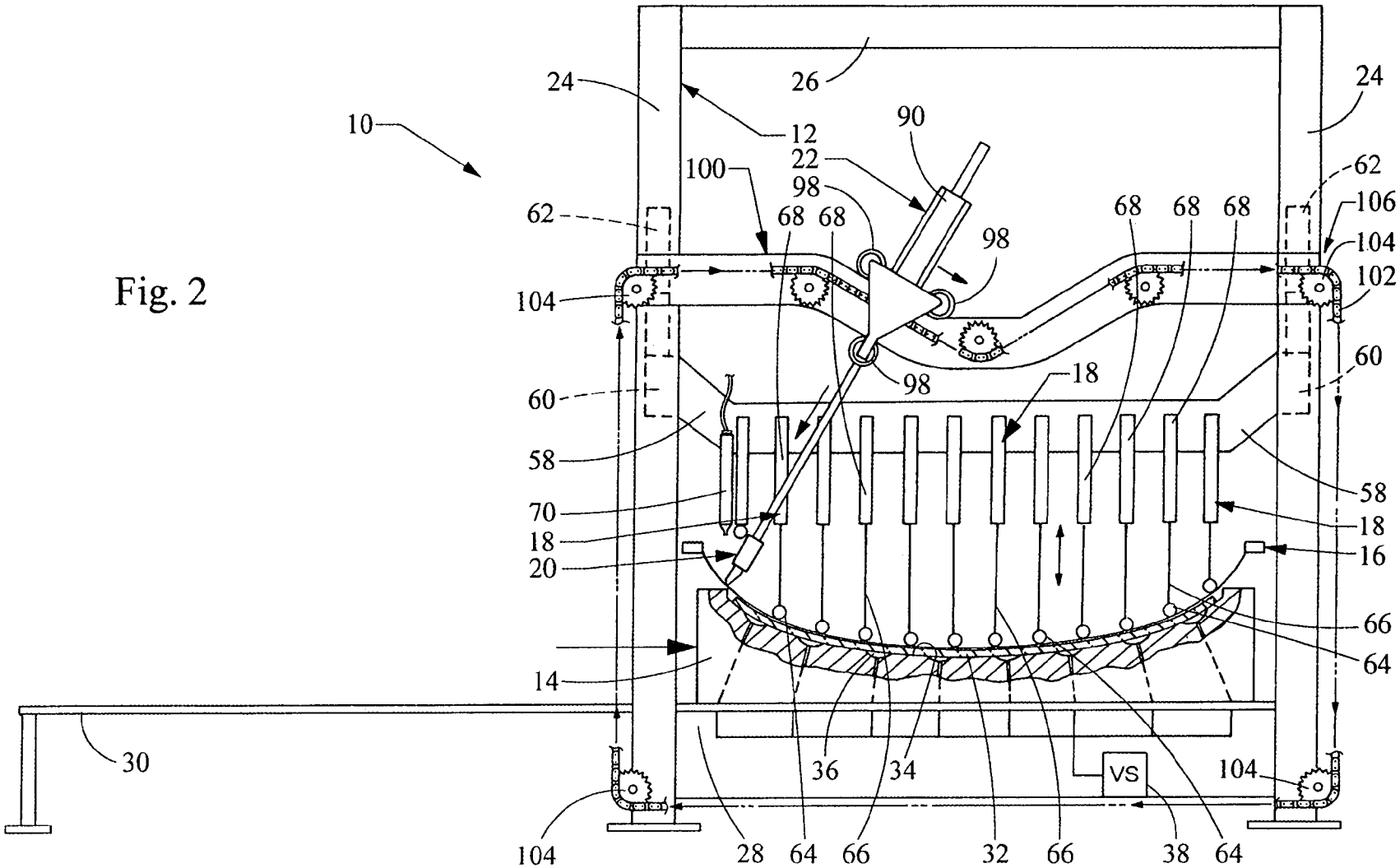
FIG. 2 is a side elevational view of the screen printing machine seen in FIG. 1 with the screen shaper assembly and screen conformed to the shape of the three dimensional surface.
Figure 3:
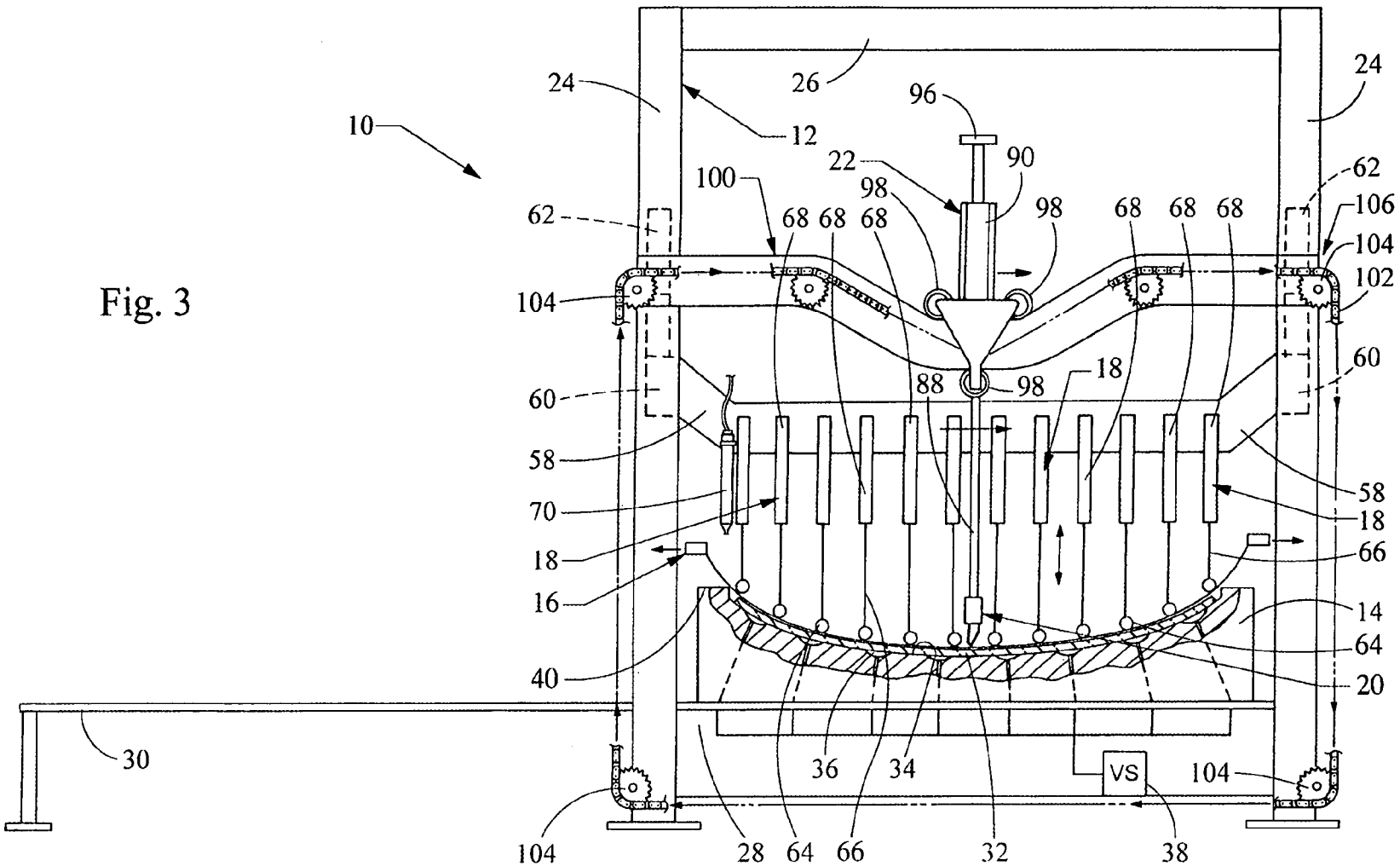
FIG. 3 is a side elevational view, similar to FIG. 2, with the squeegee having been drawn approximately halfway across the screen surface.

Once the substrate 32 is secured to the fixture 14, the fixture 14 is moved into the printing position of FIG. 2 where the substrate 32 and fixture 14 are generally located within the frame 12 of the machine 10. In this position, the screen assembly 16 is lowered toward the substrate 32.

Figures 5A, 5B:
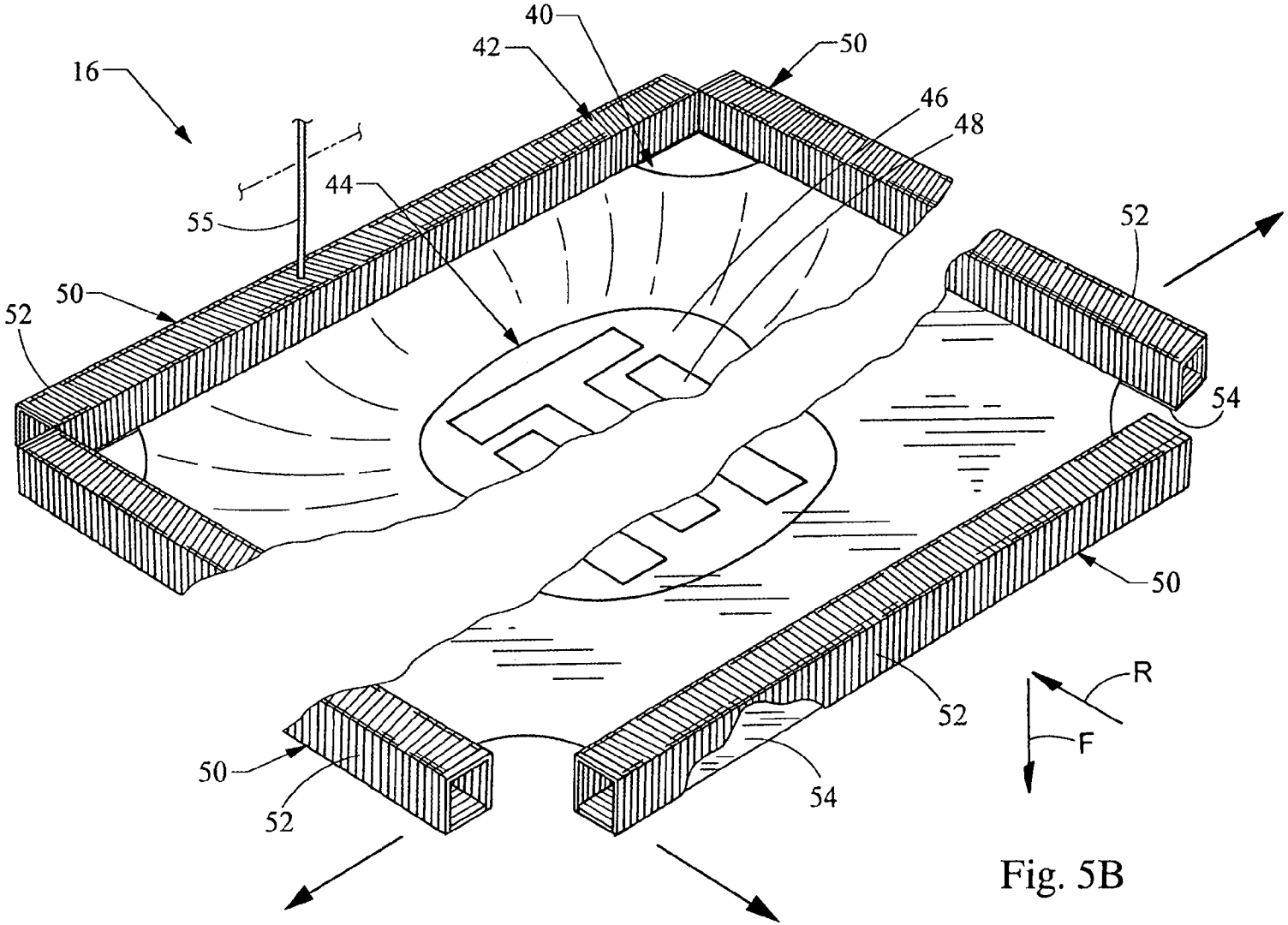
FIG. 5A is a perspective view of one embodiment of a screen assembly embodying the principles of the present invention, with all of its frame segments in an inward position.
FIG. 5B is a perspective view of the screen assembly seen in FIG. 5A with all of its frame segments in an outward position and the screen being drawn taunt.

As seen in FIG. 5A, the screen assembly 16 includes a screen 40 supported by a screen frame 42. The screen 40 is constructed of a mesh material that is porous and flexible, such as polyester, polyamide or a combination of these two materials. The screen 40 could also be constructed of a mesh that incorporates different thread diameters and/or combines different mesh material; for example, using polyester thread in on direction and polyamide in the other direction. Obviously, other materials, including those conventionally used in the screen printing industry, could alternatively be used.

An image 44 to be applied to the substrate 32 is formed on the screen 40. The image 44 is basically a stencil defining porous portions 46 and non-porous portions 48 on the screen 40. During use, the porous portions 46 will allow a printing medium, such as ink, to pass through the screen 40 and be applied to the substrate 32 according the image 44. The image 44 is formed onto the screen 40 by conventional processes used in the industry and need not be detailed herein.

The screen frame 42 is constructed so as to enable tensioning of the screen 40, while at the same time providing a degree of flexibility to the screen 40. In one embodiment, the screen frame 42 is constructed of four frame segments 50 positioned about the perimeter of the screen 40. These frame segments 50 are constructed such that they exhibit flexibility in a direction perpendicular to the plane defined by the screen 40, when the screen 40 is in a taunt undeformed condition. Laterally, in the direction of the plane, the construction of the frame segments 50 is such that the frame segments 50 are substantially ridged and will not deflect. In FIG. 5B these directions are generally designated by arrow F (for "flexible") and arrow R (for "rigid"), respectively.

To provide the frame segments 50 with such flexibility, in one construction the frame segments 50 are formed of a series of relatively loose interlocking members 52 each of which overlaps and interlocks with the adjacent number 52. This loose interlocking connection between the members 52 provides the frame segments with flexibility not only in the direction of arrow F, but also in the direction of arrow R and other direction. In order to restrict flexibility in the direction of arrow R one or more thin metal straps 54 are secured to each of the interlocking members substantially along length of the bottom frame segments 50. The interlocking members 52 may be constructed of metal such as aluminum, stainless steel, or any other desired material. The straps 54 may be constructed of metal, such as spring steel or any other desired material.

Alternate constructions for the frame segments 50 can be envisioned, such as a series of frame elements, hinged together and extending along the length of the frame segment. Any number of hinges can be used.

In order to bias and shape the frame segments 50 into a generally straight and non-flexed orientation, frame shaping means 55, such as cables, springs, belts, mechanical arms and systems, etc., may be extended through the frame segments 50, may attach to the machine frame 12 or may otherwise support the frame segments 50. This frame shaping means 55 may provide a predetermined amount of tension to the frame segments 50 or, if desired, may be provided in a construction allowing for adjustment of the tension. The frame shaping means may thus include members contracting and pushing or pulling on the frame segments 50 at one or more locations.

With the screen 40 taunt, ink is dispensed onto the screen 40 by an appropriate ink dispensing mechanism 70. The ink dispensing mechanism 70 may apply the ink in a line across the screen, generally oriented with the length of the squeegee assembly 20, or may dispense the ink in a single location on the screen 40. Finally, if required, a flood bar (not shown) is drawn and used so as to spread the ink across the surface of the screen 40 before the screen shapers 18, further discussed below, deform the screen 40 generally into the configuration of the substrate 32.

Figures 5C, 5D:
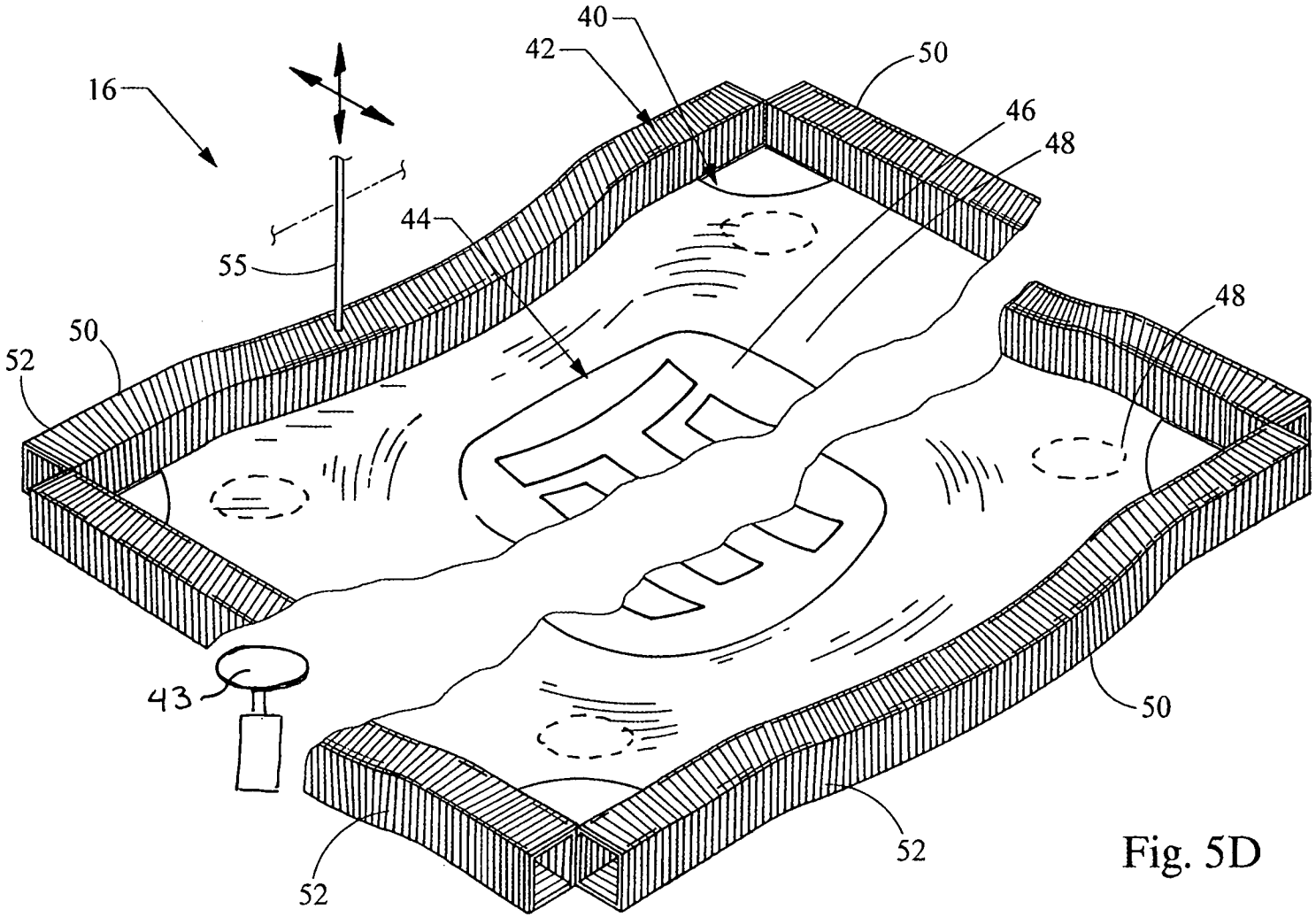
FIG. 5C is a partial perspective view of the screen assembly seen in FIG. 5A with the side frame segments of the assembly being shaped, while the end frame segments are unshaped.
FIG. 5D is a partial perspective view, similar to FIG. 5C, with the side frame segments and the end frame segments both in a shaped position.
Figure 6A:
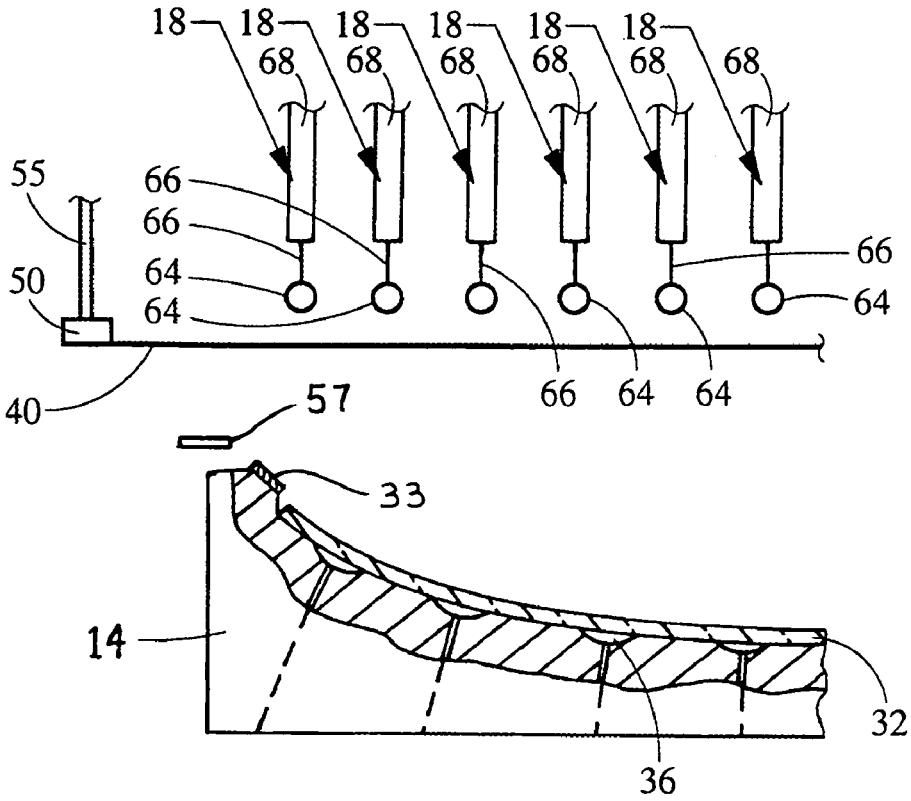
FIG. 6A is a partial schematic illustration of the substrate, fixture, screen assembly and screen shaper assembly prior to shaping of the screen.
Figure 6B:
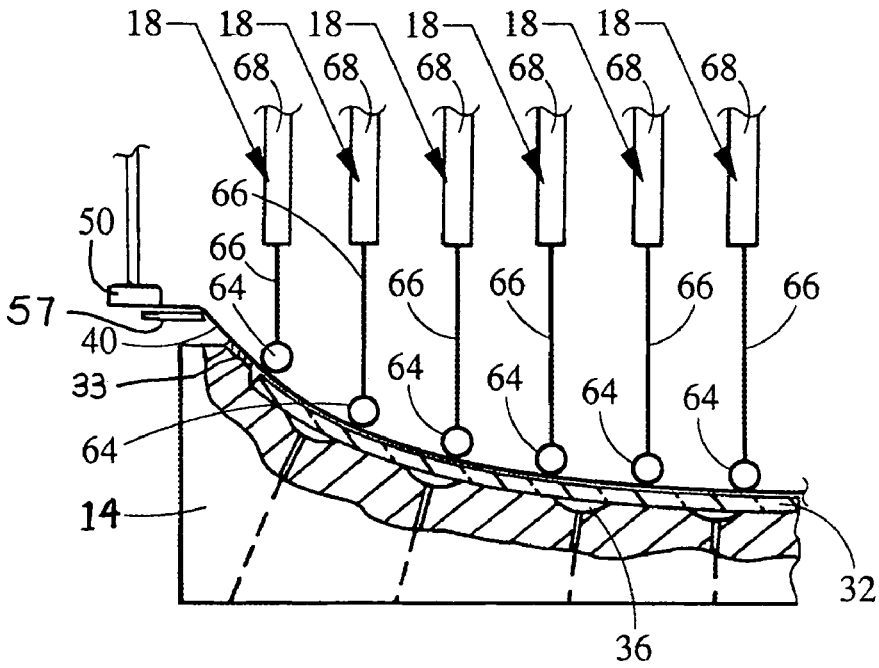
FIG. 6B is a partial schematic illustration of the substrate, fixture screen assembly and screen shaper assembly after the shaping of the screen.

As the screen assembly 16 is lowered to the appropriate initial height, the frame segments are moved inwardly (as seen in FIG. 5A) by the frame shaping means 55, allowing the screen 40 to generally drape downward from the taunt condition (seen in FIG. 5B). Thus, one or more frame segments 50 are shaped (FIGS. 5C and 5D) by the frame shaping means 55 as desired to further aid in conforming the screen 40 to the substrate. With the screen frame 42 generally shaped by the frame shaping mechanism with respect to the fixture 14 and substrate 32, the screen shapers 18 are lowered and brought into a position where they contact and shape or conform the screen 40 substantially into a shape corresponding to the shape of the substrate 32. Preferably, the screen shapers 18 (only some of which are shown and designated in the figures) maintain the screen 40 a predetermined off-contact distance, such as ¼ inch, from the surface of the substrate 32 and not directly in contact with the substrate 32. However, if desired, the screen shapers 18 can press the screen 40 into contact with the substrate 32. By varying the positions the frame shaping mechanism 55 and the screen shapers 18, the tension on the screen 40 can be altered as desired and the screen 40 can be positioned so its sides smoothly lead into the substrate 32 (as seen in FIG. 6B). Alternatively, plates or other structures located between the screen and the fixture can be employed to position and orient the screen 40 for a smooth lead into the substrate 32. Additionally, localized screen pleating can be minimized by the use of strategically located disk-shaped bodies 43, which can be moved in a generally upward direction into the screen to create tension. The movement can be controlled by actuators 45, which are mounted on bed 28. Alternatively this can be achieved by providing the disk-shaped bodies 43 at a fixed position and appropriately lowering the screen 40 down upon them.

In order to achieve the above, the screen shapers 18 are provided in an array that substantially covers the length and width of the substrate 32. In one embodiment, the screen shapers 18 themselves are carried in rows on a series of base rails 58. The direction of these rows is such that they coincide with the direction in which the squeegee assembly 20 is drawn across the substrate 32. The base rails 58 are commonly supported by members 60 at opposing ends of the base rails 58, which are in turn coupled to actuators 62 that operate to raise and lower the support members 60, base rails 58 and screen shapers 18 as a unit. As such, the actuators 62 can be pneumatically driven, hydraulically driven, electrically driven or magnetically driven actuators.

The screen shapers 18 themselves include contacts or pads 64 provided on the distal ends of shafts 66. The shafts 66 are each individually coupled to an actuator 68 that a controller selectively raises or lowers the shaft 66 and its contact 64 so as to shape the screen 40 as desired. Preferably, the actuators 68 are double acting pneumatic piston-type or servo-motor actuator. However, other styles and varieties of actuators may be employed, so long as they are controllable as required herein.

The contacts 64 may be provided in one of many shapes and may be in the form of a round ball-like member (as shown), a flat plate member, curved dish-like member or a combination of the above and other shapes. In actual use, it is believed that a contact 64 shaped so as to conform with the shape of the substrate 32, at a location adjacent thereto, would be most beneficial. In the figures, while only one type of contact 64 is illustrated, it is anticipated that in use more than one style of contact 64 may prove beneficial. With the screen deformed as seen in FIG. 2, the squeegee assembly 20 may then be drawn across the screen 40 by the mechanism for drawing or squeegee advancing mechanism 22.

To draw the squeegee assembly 20 across the surface of the screen 40, the squeegee advancing mechanism 22 moves to the position seen in FIG. 2 where the squeegee 72 itself initially engages the screen 40. The squeegee assembly 40 is constructed so as to be able to continuously conform to the shape of the surface of the substrate 32 (upon which the image 44 is to be applied) as it is drawn thereacross. As such, the length of the squeegee assembly 20 is greater than the width of the image 44 and may be as large as or larger than the distance across the substrate 32.

Figure 7A:
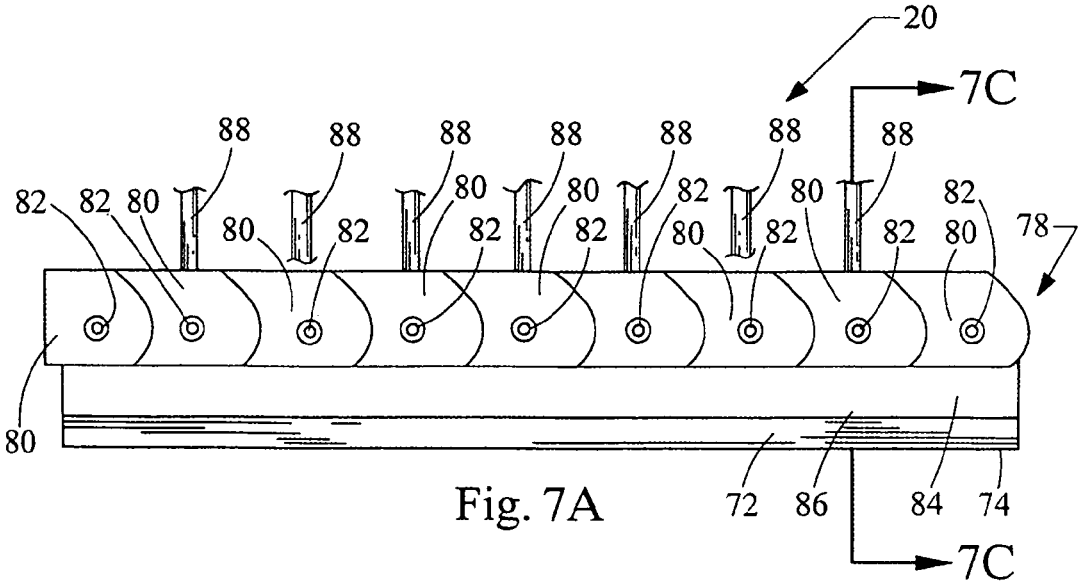
FIG. 7A is a lengthwise view of the squeegee assembly as used in the present invention.
Figure 7B:
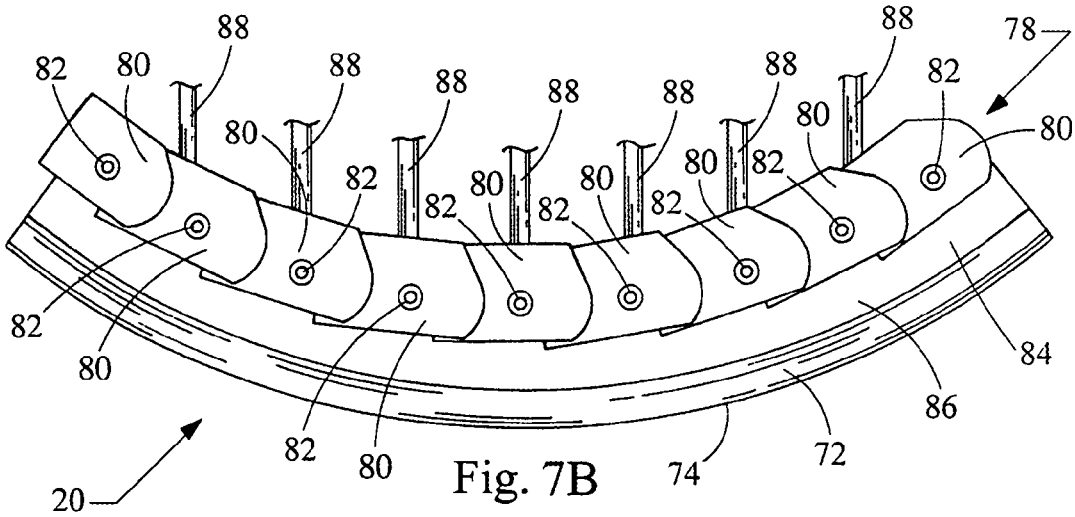
FIG. 7B is a lengthwise view of squeegee assembly seen in FIG. 7A with the squeegee in a shaped configuration.
Figure 7C:
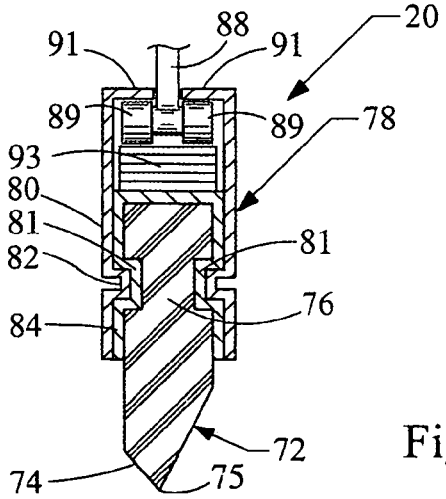
FIG. 7C is a cross-sectional view, generally taken along line 7C—7C in FIG. 7A, of the squeegee assembly.

In order to permit this squeegee assembly 20 to conform to the shape of the substrate 32, the flexible construction seen in FIGS. 7A–7C is provided. The primary component of the squeegee assembly 20 is the squeegee 72. The squeegee 72 is constructed of one of the materials commonly used for the construction of squeegees, which include various rubbers, polyurethane and others. The squeegee 72 is generally rectangular in shape and provided with a working edge 74 and a fixed edge 76. The working edge 74 is that side of the squeegee 72 that contacts the screen 40, typically at an angle, and applies pressure so as to force the ink through the porous portion 46 and onto the substrate 32. The working edge 74 may further include a pre-angled or chamfered leading edge 75, shown as being angled at 150, or another predetermined angle.

The secured or fixed edge 76 is generally opposite of the working edge 74 and is retained within a holder 78 of the squeegee assembly 20. The holder 78 is an elongated structure that is generally flexible in a plane coinciding with the squeegee 72.

In the illustrated construction, the holder 78 is segmented wherein each segment 80 is hinged or otherwise moveable relative to the immediately adjacent segments. To support the squeegee 72 within the holder 78, common or individual bushings 84 may be located between the squeegee 72 and holder 78. Accordingly, the segments 80 may be secured together via a rivet 82 or other appropriate connection to the bushing 84 and the fixed side 76 of the squeegee 72. The bushing 84 operates as a cushioning element and provides a damping force, with the holder 78, to retain the squeegee 72 within the assembly 20. To aid in locating the squeegee 72 in the holder 78, the squeegee 72 and a part of the holder 78 (such as the bushing 84) may include cooperatively engaging channels 81 therein. Preferable materials of construction for the segments 80 of the holder 78 include various metals, plastics and glass filled polyamide. Preferred materials of construction for the bushing 84 include metals, plastics, and common construction materials.

In order to make the squeegee 72 and or the bushing 84 more bendable or flexible in the plane of interest, the squeegee 72 and/or bushing 84 may be provided with a series of kerfs or notches projecting from the captured edge 76. The kerfs may be of a common depth into the squeegee (toward the working edge 74) or may be of varied or alternating depths.

Figure 4:
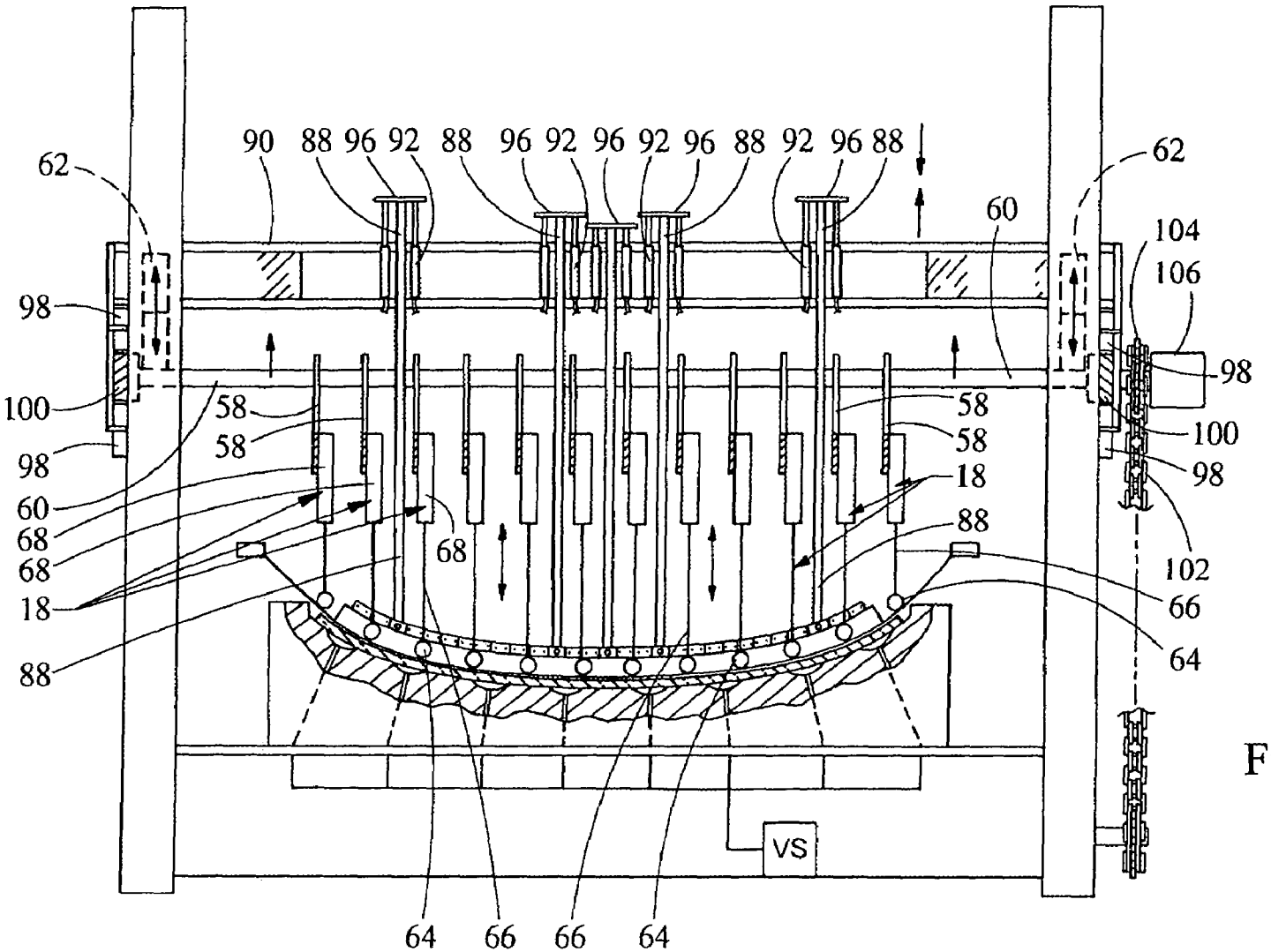
FIG. 4 is an end elevational view, with portions broken away, of the screen printing machine seen in FIG. 3.

Supporting the squeegee assembly 20 is a series of shafts 88 of the mechanism 22 for drawing the squeegee assembly 20 across the screen 40. Because the squeegee 72 flexes, it is preferred that the shafts 88 are not rigidly attached to the squeegee assembly 20. In the illustrated embodiment, this is achieved via the ends of the shafts 88 being provided with rollers or bearings 89 captured by a flange 91 of the holder 80, between the flange 91 and the top of the squeegee 72. Between the rollers 89 and the top of the squeegee 72, spring steel strips 93 are provided so as to run along the length of the squeegee 72. The spring steel strips 93 operate so as to smooth out the bending of the squeegee 72 and distribute the localized forces created by the rollers 89 and shafts 88. As perhaps best seen in FIG. 4, the shafts 88 are coupled through a print head 90 so as to be advanced or retracted by means of pneumatic, hydraulic or other styles of actuators 92. To reduce bending forces applied to the shafts 88, the shafts 88 are connected to a pressure plate 96 at their ends, which is in turn connected to a pair of actuators 92 and located on opposite sides of the shafts 88.

At its ends, the print head 90 is supported by rollers 98 that ride on a guide rail 100. The guide rail 100 is preferably shaped such that the squeegee assembly 20 will generally follow the shape of the substrate as the print head 90 is moved along the length of the guide rail 100. In such construction the guide rail 100 is generally a template for the shape of the substrate 32. It will be appreciated, however, that the guide rail 100 could alternatively be provided as a straight member wherein the squeegee assembly 20 is adjusted in position relative to the substrate 32 by the actuators 92, with or without additional actuators, and an electronic controller specifically programmed to cause the squeegee 72 to follow the shape of the substrate 32.

A wide variety of drives can be employed to move the print head 90 and squeegee 72 via the rollers 98 along the guide rail 100. In the construction seen in FIGS. 1–4, the print head is coupled to an endless chain 102 that is directed along the length of the guide rail 100. Adjacent to the ends of the guide rail 100 the chain 102 engages with sprockets 104, at least one of which is driven by an electric motor or other drive 106. Additional sprockets 104 may be provided to further support the chain 102. In an alternate drive system, the chain and its associated components may be replaced by belts, cables or other means.

As mentioned previously, the screen shapers 18 are provided in an array of rows, wherein each row is supported on a base rail 58. The shafts 88 extending from the print head 90 and supporting the squeegee assembly 20 are aligned such that each shaft 88 extends between adjacent rows of the shapers 18 and base rails 58 supporting them. As should be apparent, this allows for the shafts 88 to move across the substrate without interference by the screen shapers 18 and their respective base rails 58. In order to prevent the squeegee assembly 20 from colliding with and being obstructed by the shafts 66 and contacts 64 of the screen shapers 18, retraction and extension of the shafts 66 and contacts 64 of the screen shapers 18 is timed or choreographed with the drawing of the squeegee assembly 20 across the screen 40. Thus, when the squeegee assembly 20 approaches a contact 64 of a screen shaper 18, the respective actuator 62 causes a retraction of the shaft 66 and a lifting of the contact 64 out of engagement with the screen 40. The contact 64 is lifted to a height that allows the squeegee assembly 20 to pass beneath it. The actuator 62 then advances or lowers the shaft 66 again placing the contact 64 in contact with the screen 40 so as to position the screen 40 at the appropriate off-contact distance. This process repeats itself as the squeegee assembly 20 approaches the next successive screen shaper 18. In short, each screen shaper 18 in a row of screen shapers 18 is successively raised in and lowered as the squeegee assembly 20 is drawn across the screen 40.

In drawing the squeegee 72 across the screen 40, the present invention envisions that the squeegee 72 can be drawn across the screen 40 with the squeegee 72 perpendicular to the direction in which the squeegee 72 is drawn, with the squeegee 72 angled with respect to the direction in which the squeegee 72 is drawn, or with the squeegee 72 changing its angle with respect to the direction in which the squeegee 72 is drawn. In the above instances, the angle is defined between the direction of travel and the length of the squeegee 72.

Once the squeegee assembly 20 has been drawn completely across the screen 40, the image 44 will have been transferred to the substrate 32. Printing of the image 44 onto the substrate 32 is thus completed, except for drying and curing of the transferred image and removal of the printed substrate 32 from the fixture 14 and the machine 10. To effectuate these last steps, the screen shapers 18 are all retracted by their respective actuators 68 and the support member 60 raised by actuators 62, thereby raising the base rails 58 and all of the screen shapers 18 as a unit. The squeegee assembly 20 is similarly raised by the shafts 88 and actuators 92. Preferably, the squeegee assembly 20 is raised to a height which will allow the squeegee assembly 20 to pass beneath all of the screen shapers 18, after the latter have been similarly raised. The mechanism 42 for drawing the squeegee assembly 20 across the screen 40 is then reversed by the motor 106 and the rollers 98 follow the guide rail 100 so as to move the print head 90 to its initial position toward one side of the machine frame 12. The fixture 14 is withdrawn along the rails 30 to a position located generally outside of the machine 10, the vacuum source 38 is deactivated and the vacuum cups 36 release the substrate 32 to an appropriate take-out mechanism (not shown). Another substrate 32 is then loaded into the fixture 14 and the process repeated.

Figure 8A:
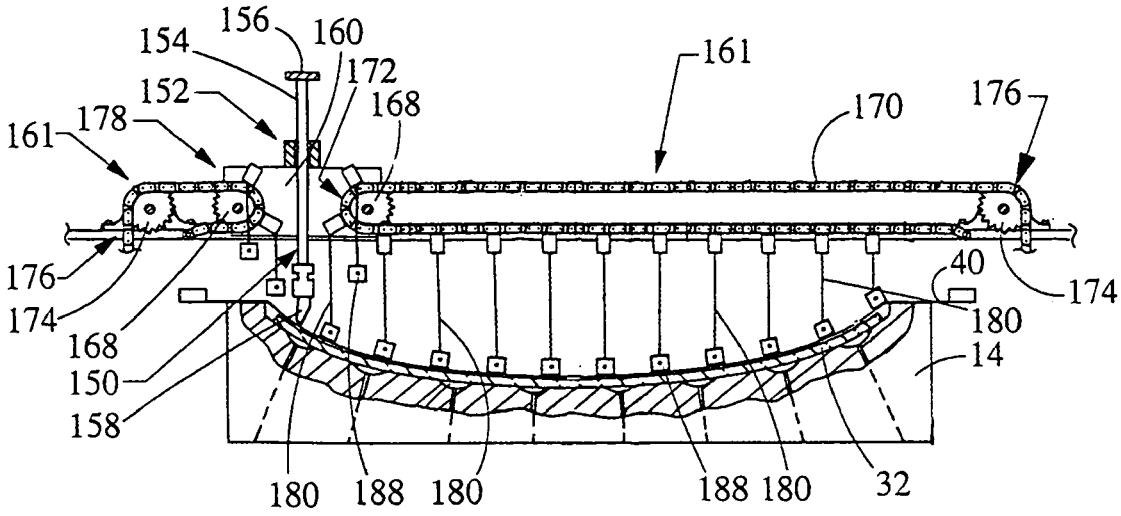
FIG. 8A illustrates a further embodiment of a screen shaping assembly and squeegee assembly with the squeegee at a position after initial movement across the screen.
Figure 8B:
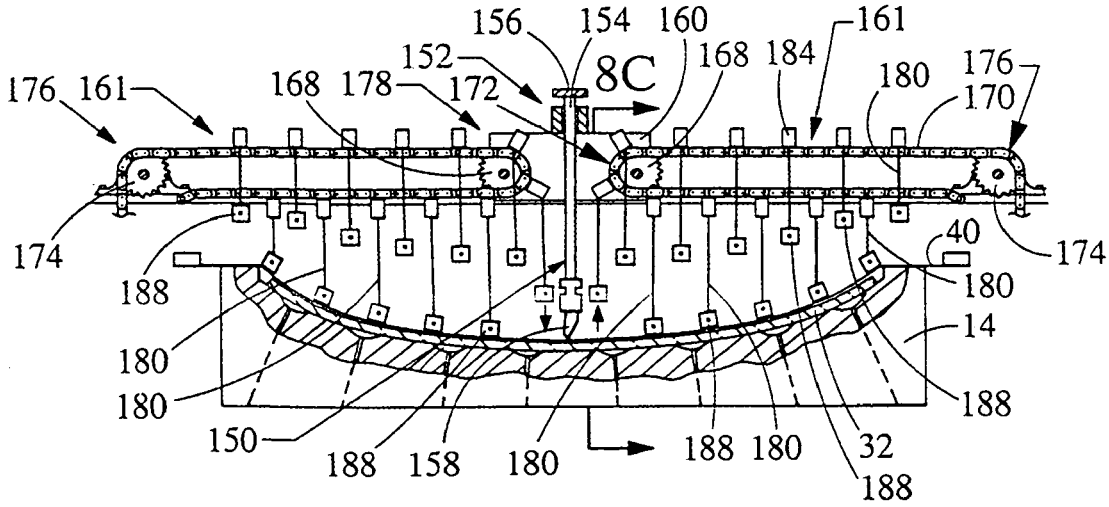
FIG. 8B illustrates the embodiment of FIG. 8A at a later position of movement of the squeegee across the screen.
Figure 8C:
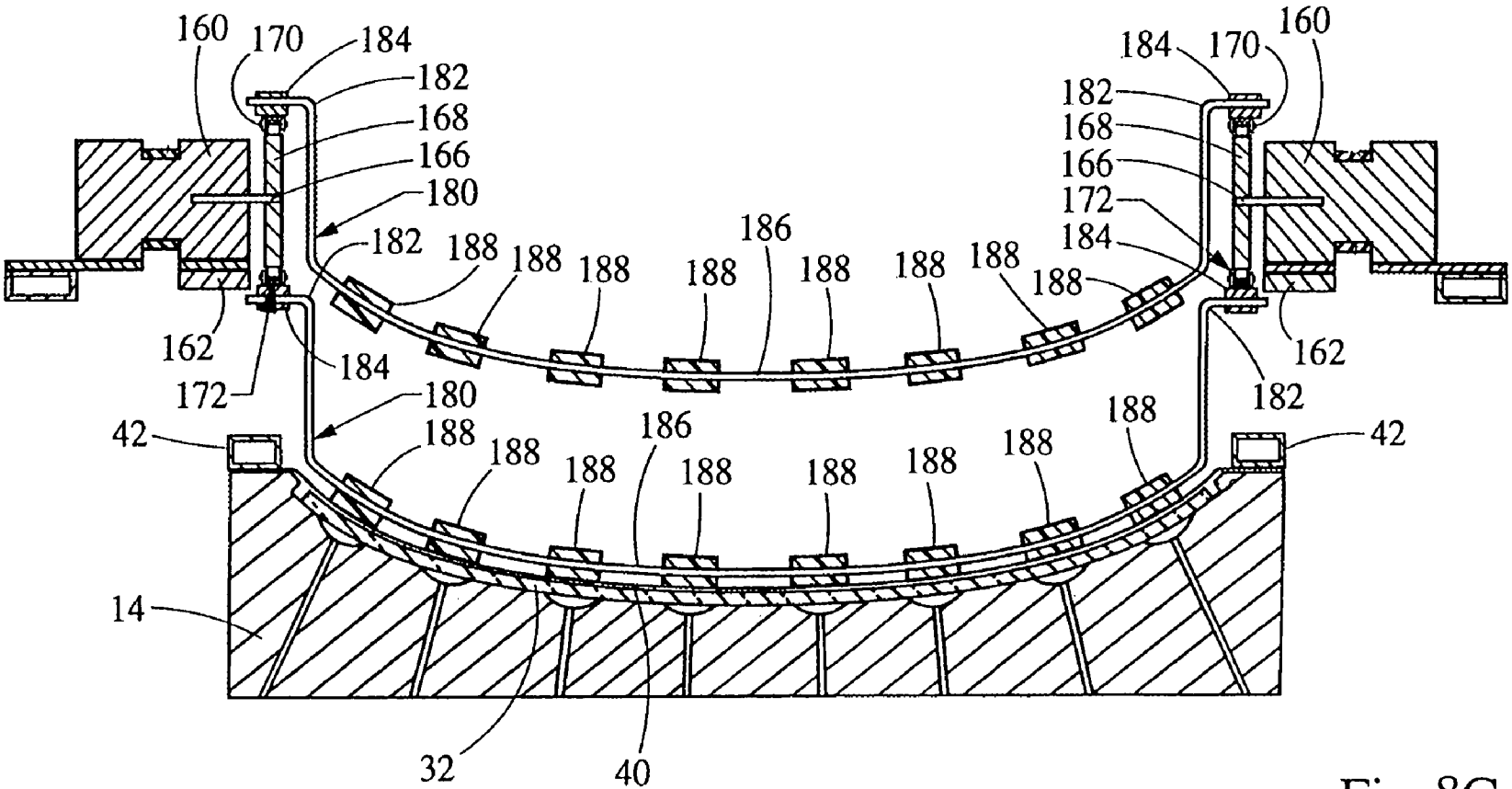
FIG. 8C is a sectional view, generally taken along line 8C—8C of FIG. 8B, illustrating the bails and screen shapers at various stages of engagement and disengagement with the screen.

As an alternative to the screen shaper assembly 18 and squeegee assembly 22 discussed above, an additional construction is shown in FIGS. 8A, 8B and 8C. Generally, in this construction the retraction and extension of the screen shapers are mechanically tied to movement of the squeegee across the substrate 32 and screen 40.

As seen in FIG. 8A, the squeegee assembly, generally designated at 150, is similarly connected to a print head 152 and raised and lowered by actuators (not shown) coupled to a shaft 154, via a pressure plate 156, to support a squeegee 158. Opposing ends of the print head 152 are supported on guide blocks 160. The guide blocks 160 are linearly moveable along rails 162 by chain 170 coupled to an actuator, such as a motor (not shown) or other means. Alternatively, the print head 152 is supported separate from guide blocks 160, and controlled to move in concert with, and to stay within, the gap between the two sets of shapers further discussed below.

In this screen shaping assembly 161, the construction of the squeegee assembly needs not have specific openings or gaps provided therein to allow the individual screen shapers to pass through or over the squeegee as it is drawn across the screen. Rather, the screen shaping assembly 161 of this second embodiment generally includes two complete sets of shapers extending from opposite sides of the guide block 160. The sets are similarly constructed and, as will be appreciated from the discussion that follows, as the squeegee assembly 150 is drawn across the screen 40 one set of the screen shaping assembly 161 will be lifting its screen shapers off of the screen 40 in front of the squeegee 158 and the other set will be placing its screen shapers onto the screen 40 behind the squeegee 158.

As part of the screen shaping assembly 161, two sprocket wheels 168 (or pulleys) are carried on axles 166 that protrude laterally inward from each of the guide blocks 160. The sprocket wheels 168 therefore move with the guide blocks 160, but are freely rotatable on the axles 166.

Commonly engaged with the both of the sprocket wheels 168 is a chain 170, belt or other conveyor means. The chain 170 is of a fixed length and has one end attached adjacent to one side of the machine 10, a first portion 172 in contact with one of the sprocket wheels 168 and a second portion 174 engages with one or more additional sprocket wheels 176 fixed in position relative to the machine 10. A third portion 178 of the chain 170 engages with the other sprocket wheel 168 and is attached to the guide block 160. The chain 170 thereafter terminates and is attached to the machine 10 at the opposing side of the machine 10. As such, with both of its ends fixed, relative portions of the chain 170 are moved as the guide blocks 160 are being moved along the rails 162.

Suspended from the chain 170 at predetermined intervals are bails 180. The bails 180 are connected at their ends 182 to the chain 170 by mounting blocks or other couplings 184. The bails 180 are suspended inward from the couplings 184, as seen in FIG. 8C, toward the screen 40 and are freely rotatable with respect to the couplings 184, but fixed while located in their extended position, the position in contact with the screen 40. The couplings 184 have a locking mechanism to allow for maintaining this fixed orientation of the bails 180. Additionally, the bails 180 slope generally downward from their ends 182 to a conformed portion 186 that is shaped so as to correspond to the shape of the substrate 32.

Located on the conformed portion 186 are a series of screen shapers 188. The screen shapers 188 may be constructed of foam blocks having a bore or channel defined therein through which the conformed portion 186 of the bail 180 passes. Preferably, the screen shapers 188 are mounted on the conformed portion 186 such that it can be moved there along and repositioned if desired at an appropriate location relative to the screen 100 and the substrate 130. To achieve this, the screen shapers 188 may be retained on the conformed portions 186 by a frictional engagement. Additionally, the screen shapers 188 may be mounted to the conformed portion 186 so as to readily enable removal of the screen shapers 188 from the bail 180 if desired.

As seen in FIG. 8A, since the chain 170 is fixed at both of its terminal ends, as the chain 170 is being driven the sprocket wheels 168 cause the chain 170 to rotate there around. As the chain 170 rotates, the screen shapers 188 located in front of the direction of movement of the squeegee 158 are caused to be picked up off of the screen 40 as their respective bail and coupling 180, 184 is moved around the lead sprocket wheel 168. Oppositely, trailing behind the squeegee 158 the chain 170 rotates about the trailing sprocket wheel 168 so as to lower and place the screen shapers 188 onto the screen 40 as the respective bails and couplings 184 are moved there around. FIGS. 8A and 8B illustrate the movement of the squeegee assembly 150 from a position in FIG. 8A just after the squeegee 158 has initially begun movement to a second position seen in FIG. 8B, where the squeegee 158 has progressed further through the printing cycle and generally from left to right. As mentioned above, as a further alternative embodiment, the print head 152 may be independently supported and moved. When provided in this manner, movement of the print head 152 is coupled to movement of the two sets of shapers so that the print head 152 will remain located in the gap between the two sets of shapers.

Figure 9:
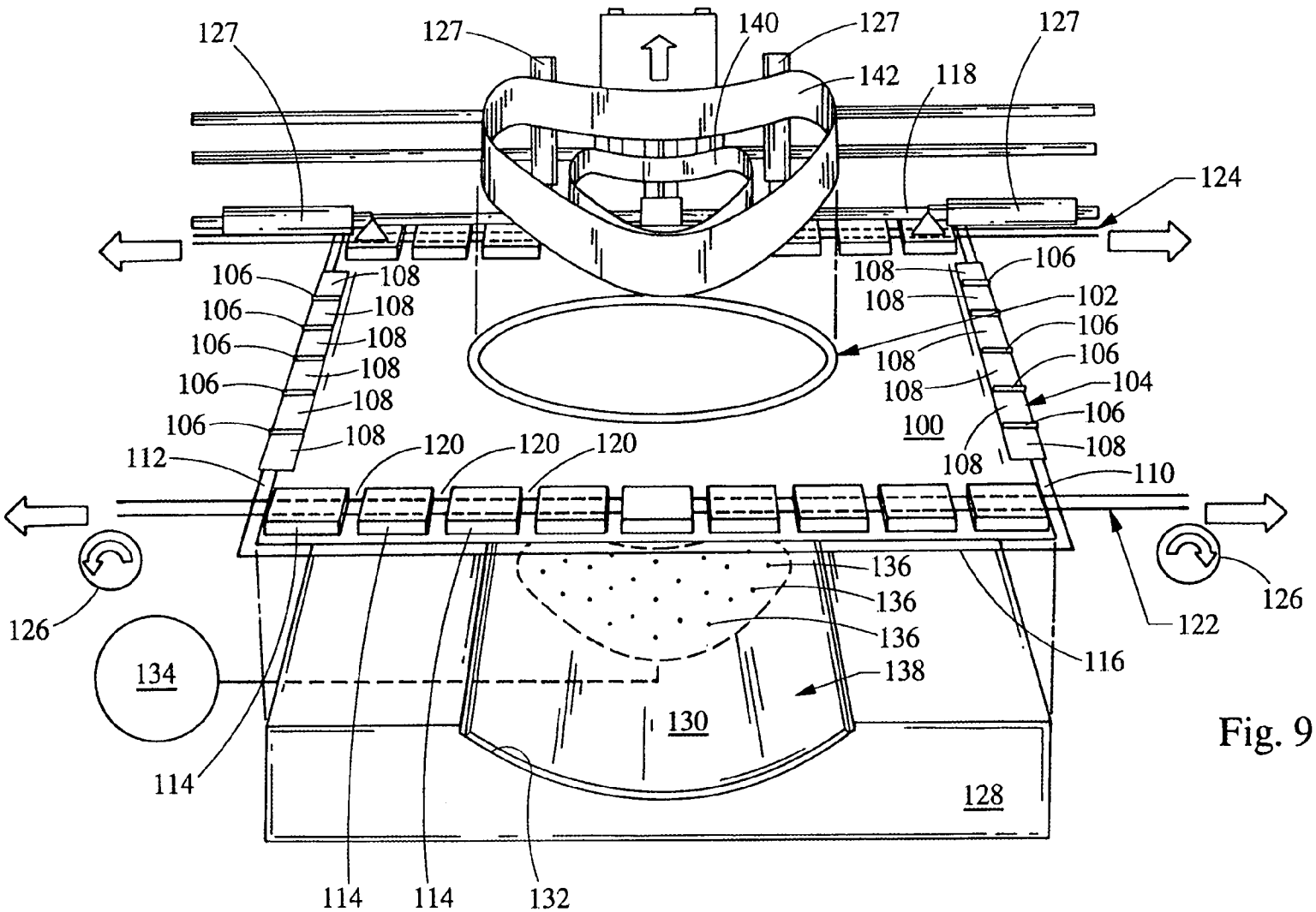
FIG. 9 is a diagrammatic view of another embodiment of the present invention.

FIG. 9 depicts a further embodiment of the present invention and includes a flexible screen 100, preferably constructed of a monofilament polyester material, although other flexible materials capable of receiving and transferring a pigment-containing material (not shown) known to those skilled in the art of screen printing may be used. While one particular image 102 is depicted on the screen 100, any image can be provided on the screen 100 having any shape, design and/or pattern without departing from the scope of the present invention.

The screen 100 is located on a screen frame 104 that supports the screen 100, preferably attaching to one or more edges of the screen 100. The screen frame 104 includes sides designed to flex, or bend, in at least two locations, to allow the frame 104 to deform in a complementary shape with the flexible screen 100. Preferably, the screen frame 104 is designed to flex in a plurality of locations and in at least two dimensions to allow it to deform with the flexible screen 100. If desired, a rigid screen frame could alternatively be used with the screen contact structures 140, 142, mentioned below.

To allow it to flex with the screen 100, the screen frame 104 may be provided with one or more hinges 106 between sections 108 thereof. Other devices and structures known to those skilled in the art to allow the frame 104 to flex are also within the scope of the present invention. For example, an elastic material, such as spring steel, may be located between sections of the screen frame 104 to facilitate frame 104 flexing or bending. Although spring steel is disclosed, those skilled in the art will appreciate that any flexible material may be used. In one construction, it may be preferred to have a material that returns to its pre-deflected condition so that it urges the frame 104 and screen 100 back into their original flat orientation after being deformed.

In the embodiment depicted in FIG. 9, the sections 108 of the screen frame 104 are provided as a plurality of plates, coupled together by hinges 106, along a first edge 110 and a second edge 112 of the screen 100. Additional sections 114 may also be located along a third edge 116 and a fourth edge 118 of the screen 100. A gap 120 may alternatively be provided between each of the sections and is illustrated with respect to sections 114. The flexible frame 104 and screen 100 are permitted to bend as a result of the gaps 120. The sections 108, 114 may be any length, width or number.

As noted above, the sections 108, 114 and the hinges 106 and gaps 120 allow the screen 100 to deform in any shape. For example, the screen 100 may deform in convex, concave, planar, and/or conical shapes. Additionally, the screen 100 may deform in any combination of the above shapes, which is herein designated as a compound shape.

The gaps 120 may also be reinforced for strength, stability and/or to add elasticity. For example, spring steel, or any other elastic material, may be added in any orientation and any amount in or adjacent the individual gaps 120. Additionally, or alternatively, a fabric, mesh, polyamide, plastic, and/or additional screen material and/or layers of any of the foregoing may be located in or adjacent the individual gaps in any amount in any orientation for strength and/or stability. If additional screen material is used, the same screen material used for the entire screen may be used, or other coarser or finer screen material may be used.

FIG. 9 also depicts a first cable assembly 122 and a second cable 124 attached to the sections 114 located along the third edge 116 and fourth edge 118 of the screen 100, respectively. The cables 122, 124 may be constructed out of any material, such as metal and/or plastic, and they may have any degree of stiffness. Preferably, each end of the first cable assembly 122 and each end of the second cable assembly 124 is attached to one or more manually or automatically operated tensioning and/or relaxing mechanisms 126. Preferably, each cable assembly 122, 124 includes at least two cables to provide sufficient screen tensioning and/or screen relaxing control.

Figure 10:
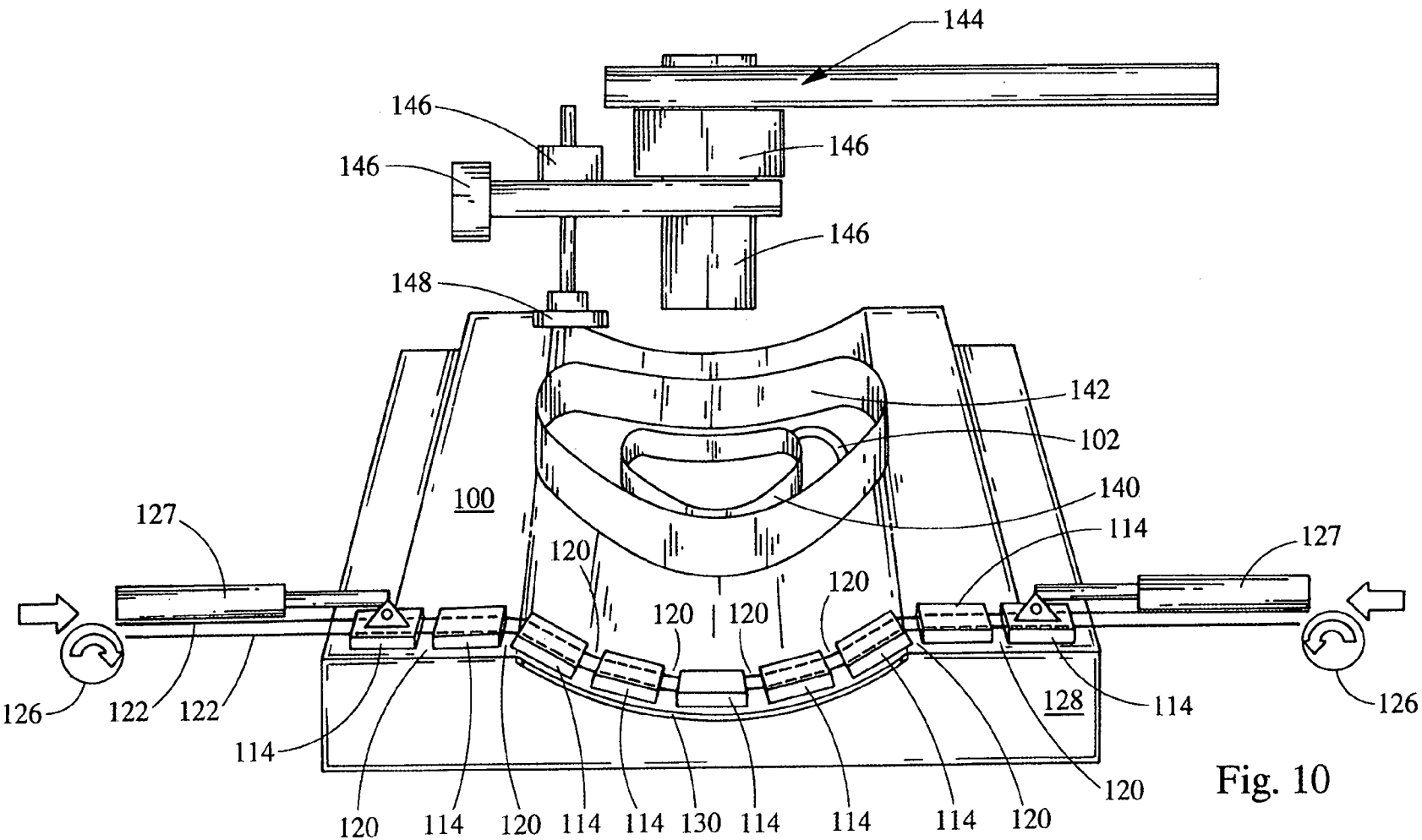
FIG. 10 is a diagrammatic view of the apparatus seen in FIG. 9 with the screen having been conformed with the shape of the three-dimensional surface.
Figure 11:
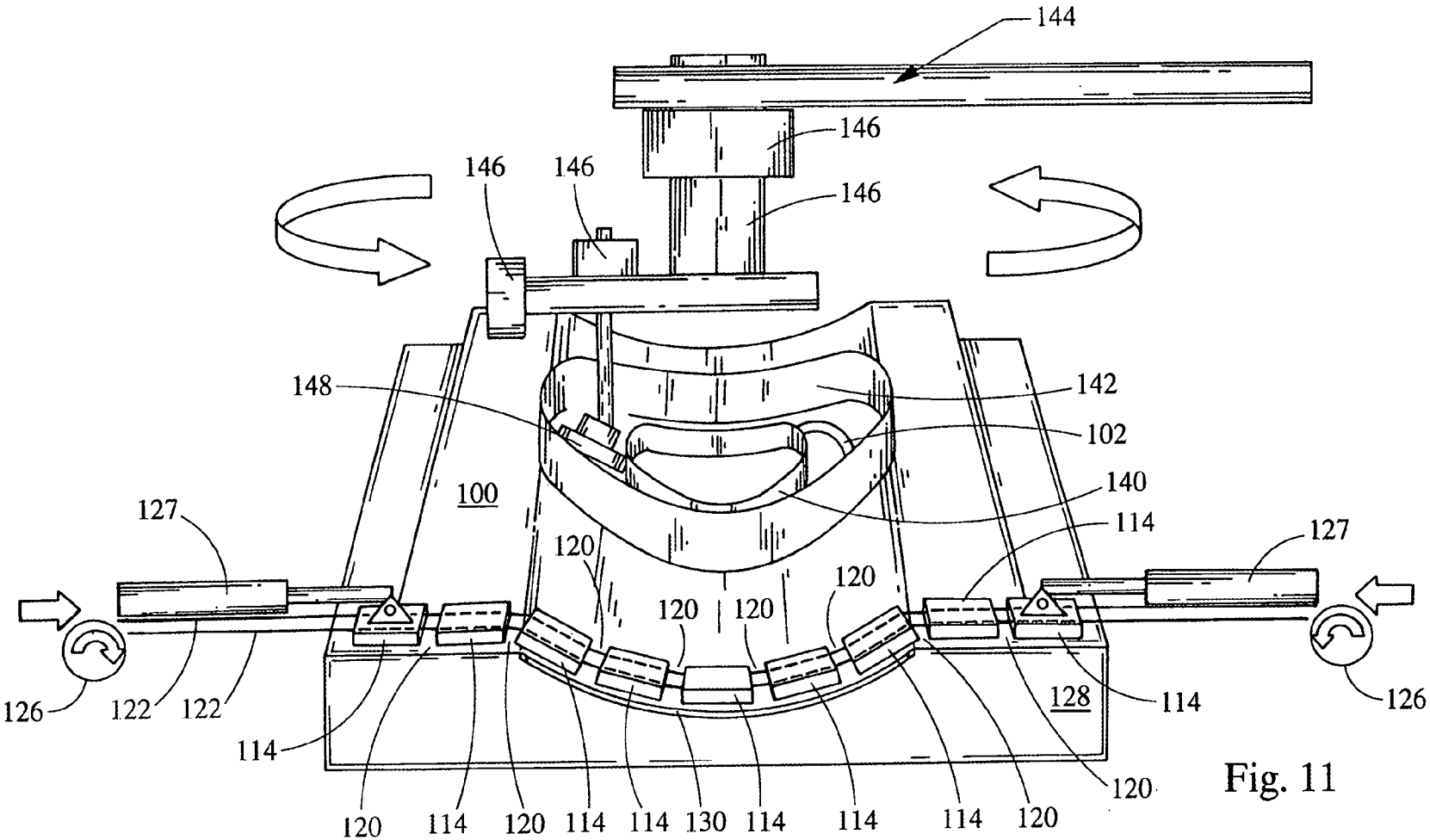
FIG. 11 illustrates a squeegee being moved so as to force a printing medium through the porous portion of the screen assembly seen in FIG. 9.

In addition to the tensioning mechanism 126, frame shapers 127 are provided to deform the screen frame 104 to a shape preferably corresponding to the shape of the substrate 130, further discussed below. The frame shapers 127 may be coupled directly to the segments 108, 114 of the frame and utilized any actuation means (e.g. mechanical, pneumatic, hydraulic, electrical, servo motors) to aid in positioning the screen. In FIG. 9–11, the frame shapers 127 are shown associated with that portion of the screen frame 104 defining the third and fourth edges 116, 118. It will be readily appreciated that the frame shapers 127 could additionally and alternatively be provided along the first and second edges 110, 112 of the screen 100.

As also depicted in FIG. 9, a substrate fixture 128 is provided for supporting one or more substrates 130 onto which printing is desired. Preferably, the substrate fixture 128 a complementary shape to the substrate 130. In a preferred embodiment, the substrate fixture 128 has at least one recessed portion 134 for securely receiving and supporting the substrate 132. The substrate fixture 128 may be specifically designed for a single substrate 130, or it may be designed to accept a plurality of individual substrates having different shapes, curvatures, and/or designs. If the substrate fixture 128 is designed to accept a plurality of substrates, an adjusting mechanism (not shown) is preferably provided in or on the substrate fixture 128. The substrate fixture 128 may be of a single piece construction or of a multi-piece construction.

The substrate fixture 128 is connected to one or more vacuum sources 134. A plurality of ports 136 are provided in the recessed portion 132 in fluid communication with the substrate 130 and the vacuum source 134. With activation of the vacuum source 134, the substrate 130 is selectively secured to the substrate fixture 128.

The substrate 130 may be planar, and/or have one or more concave surfaces, one or more convex surfaces, one or more conical surfaces, or any combination thereof. Compound surfaces are constructed, at least partially, by combining one or more convex, concave, planar and/or conical surfaces. Preferably, an inside surface 138 of the substrate 130 will be printed using the methods described below; however, it is within the scope of the present invention to print any surface of the substrate 130.

As further seen in FIGS. 10 and 11, an inner contact structure 140 and an outer contact structure 142 are located adjacent the screen 100 by manual and/or automatic means. The means may control the contact structures 140, 142 to move as one, or the contact structures 140, 142 may be independently moved with respect to each other. The inner and outer contact structures 140, 142 may be of a one-piece construction or a multi-piece construction. Regardless of their construction, they preferably have surfaces or edges that are complementary shape to the substrate 130.

The manual and/or automatic means place the inner and outer contact structures 140, 142 in contact with the screen 100 to deform the screen 100 into a complementary shape with the substrate 130, as seen in FIG. 10. In the specifically illustrated embodiment, the inner and outer contact surfaces 140, 142 at least partially enclose the image 102 on the screen 100 when they are placed in contact with the screen 100. For example, the inner contact structure 140 may be located inside the image 102 and the outer contact structure 142 may be located outside the image 102 to facilitate printing, as described in more detail below. The present invention also includes one or more sets of contact structures to conform the screen 100 to the shape of the substrate 130.

Preferably, at least one structure (not depicted) for locating pigment-containing material, such as printing ink, is provided adjacent the screen 100. The structure is designed to deliver a pre-determined quantity of pigment-containing material to an upper surface of the screen 100 at a predetermined time before the screen is deformed. A flood bar (not shown), as known to those skilled in the art, is provided to evenly distribute the pigment-containing material across the upper surface of the screen 100.

As further seen in FIGS. 10 and 11, a manually, or automatically, driven arm 144 is located adjacent the inner and outer contact structures 140, 142 and the screen 100. Preferably, the arm 144 is capable of movement in any direction in the x-y-z plane, for example, through one or more servo motors 146 or other movement means. At least one squeegee 146, as known to those skilled in the art, is pivotally attached to the arm 144. The squeegee 146 is shaped to fit in the space between the inner and outer contact structures 140, 142. Because of the articulating nature and construction of the arm 144, depending on the degree of curvature in the substrate 32, the use of the inner and outer contact structures 140, 142 may be eliminated.

A method of printing utilizing the embodiment of FIGS. 9–10 provides the screen 100 having the image 102 located thereon in the screen frame 104, as depicted in FIG. 9. The tensioning mechanisms 126 pull on the cables 122, 124 with a predetermined amount of force to locate a desired amount of tension in the screen 100. Pigment-containing material (not shown) is preferably, but not necessarily, provided onto the screen 100 once the screen 100 is located in a relatively flat orientation. A flood bar (not shown) is then swept over the surface of the screen 100 to evenly distribute the pigment-containing material across the image 102.

During, before, or after the tensioning and flood step, a substrate 130 is located in the substrate fixture 128. Preferably, the vacuum source 134 is engaged to secure the substrate 130 into the recessed portion 132 in the substrate fixture 128.

Simultaneously, or at different times, the substrate fixture 128 is located beneath the screen 100, by automatic or manual means, and the inner and outer contact structures 140, 142 are located above the screen 30. Preferably, the tensioning mechanism 126 relaxes each set of cables 122, 124 a predetermined amount and the screen 100 conforms to the shape of the substrate 130. The frame shapers 127 are also actuated to further aid in conforming the screen 100 to the substrate 130. In the illustrated embodiment, the inner contact structure 140 is placed in contact with a portion of the screen 100 inside the image 102 and then the outer contact structure 142 is placed in contact with a portion of the screen 100 outside the image 102, with automatic or manual means. The inner and outer contact structures 140, 142 further secure, stabilize and/or position the screen 100 adjacent to or against the substrate 130.

The arm 144 is then positioned above the screen 100, as shown in FIG. 10, locates the squeegee 148 between the inner and outer contact structure 140, 142 and, via the servo motors 146, pulls and/or pushes the squeegee 148 across the screen-100 to effect printing on the substrate 130 below, as seen in FIG. 11. Because of articulating capabilities of the arm 144, via the servo motors 146, in this embodiment when frame shapers 127 are employed, the apparatus can operate without the inner and outer contact structures 140, 142.

After printing, the arm 144 removes the squeegee 148 from the screen 100 and the outer contact structure 142 is removed, causing a portion of the screen 100 to peel away from the substrate 130. Next, the inner contact structure 140 is removed causing the remaining portion of the screen 100 to peel away from the substrate 130. The screen shapers 127 retract and the tensioning mechanism 126 pulls on the cables 122, 124 which tensions the screen 100 and locates it in a flat orientation away from the substrate 130. The substrate fixture 128 is then lowered from the screen 100 and the printed substrate 130 is removed.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

We claim:

1. A screen printing apparatus for printing images onto a three dimensional surface of a substrate, said apparatus comprising:

a screen assembly including a screen and a screen frame, said screen being formed of a flexible mesh material and at least a portion of said screen being porous so as to allow passage of a printing medium there through said porous portion, said screen frame generally defining a perimeter about said screen and supporting said screen within said perimeter;

a substrate fixture defining at least one support surface supporting said substrate generally in registration with said screen assembly;

a shaping assembly including a plurality of shapers dispersed about the surface of the screen each being movable between retracted and extended positions such that at least two shapers are extended to different lengths, in said extended positions said shapers being engaged with said screen assembly, whereby moving of at least some of said shapers to said extended positions causes said screen to generally conform to the three dimensional surface of the substrate;

a squeegee assembly including a squeegee, said squeegee assembly being flexible along its length such that said squeegee is continuously conformable along a contact edge to said three dimensional surface when drawn there along; and a mechanism coupled to said squeegee assembly and adapted to draw said squeegee along said screen so as to force at least some of the printed medium through said porous portion of said screen and onto the three dimensional surface.

2. The apparatus of claim 1 wherein said shapers contact said screen in said extended positions.

3. The apparatus of claim 1 wherein at least some of said shapers are disengaged from said screen assembly in said retracted positions.

4. The apparatus of claim 1 wherein said screen is held at an off-contact position relative to the three dimensional surface when said shapers are in said extended positions.

5. The apparatus of claim 1 wherein each of said shapers includes an arm coupled to an actuator, said arms being extendable by said actuator.

6. The apparatus of claim 5 wherein said actuator is a pneumatic actuator.

7. The apparatus of claim 5 wherein said actuator is a servo-motor.

8. The apparatus of claim 5 wherein said arms terminate at a distal end thereof in contact members that have a contact surface that is one of flat or curved.

9. The apparatus of claim 1 wherein said mesh material includes polyester.

10. The apparatus of claim 1 wherein said mesh material includes polyamide.

11. The apparatus of claim 1 wherein said screen frame is flexible.

12. The apparatus of claim 11 wherein said screen frame is flexible in at least one direction.

13. The apparatus of claim 11 wherein said screen frame is engaged with said shapers.

14. The apparatus of claim 11 wherein said screen frame has a segmented construction, adjacent segments being connected to and moveable relative to one another.

15. The apparatus of claim 14 wherein said segments are interlocked with one another.

16. The apparatus of claim 11 wherein said segments are hinged to one another.

17. The apparatus of claim 1 wherein said shapers include screen shapers and frame shapers, said screen shapers contacting said screen in said extended positions and said frame shapers engaging said frame.

18. The apparatus of claim 1 further comprising a mechanism coupled to said squeegee to conform said squeegee to a portion of the three dimensional surface.

19. The apparatus of claim 18 wherein said mechanism conforming said squeegee is adapted to apply a printing pressure over a length of said squeegee and generally perpendicular to the three dimensional surface.

20. The apparatus of claim 18 wherein said mechanism conforming said squeegee includes a plurality of rods each coupled to an actuator, said rods being extendable and retractable by said actuators.

21. The apparatus of claim 1 wherein said substrate fixture has elevated surface portions surrounding said support surface.

22. The apparatus of claim 21 wherein said elevated surface portions incorporate a means to hold said screen in a stable position along at least one side of said substrate fixture.

23. A screen printing apparatus for printing images onto a three dimensional surface of a substrate, said apparatus comprising:

a screen assemble including a screen and a screen frame, said screen being formed of a flexible mesh material and at least a portion of said screen being porous so as to allow passage of a printing medium there through said porous portion, said screen frame generally defining a perimeter about said screen and supporting said screen within said perimeter;

a substrate fixture defining at least one support surface supporting said substrate generally in registration with said screen assembly;

a shaping assembly including a plurality of shapers dispersed about the surface of the screen each being movable between retracted and extended positions, in said extended positions said shapers being engaged with said screen assembly, whereby moving of at least some of said shapers to said extended positions causes said screen to generally conform to the three dimensional surface of the substrate, said shapers including bails carried by a conveyor, said conveyor adapted to extend and retract said shapers, said bails having a central portion extending across the substrate and generally shaped and conforming with a portion of the three dimensional surface;

a squeegee assembly including a squeegee, said squeegee assembly being flexible along its length such that said squeegee is continuously conformable along a contact edge to said three dimensional surface when drawn there along; and a mechanism coupled to said squeegee assembly and adapted to draw said squeegee along said screen so as to force at least some of the printed medium through said porous portion of said screen and onto the three dimensional surface.

24. The apparatus of claim 23 wherein at least one contact is mounted to said central portion of said bails.

25. The apparatus of claim 24 wherein said contact is able to be positioned along said central portion of said bails.

26. The apparatus of claim 23 wherein said mechanism adapted to draw said squeegee is coupled to said conveyors and is moved thereby.

27. A method of printing an image onto a three dimensional surface of a substrate, said method comprising the steps of:

positioning a screen assembly, having a screen supported by a screen frame, over the three dimensional surface of the substrate;

applying a printing medium to the screen;

shaping the screen so as to generally conform with the shape of the three dimensional surface extending at least one shaper into contact with the screen to position the screen relative to the three dimensional surface;

drawing a squeegee along the shaped screen;

selectively retracting a shaper located in front of the squeegee out of contact with the screen as the squeegee is drawn along the screen and selectively extending a shaper located behind the squeegee into contact with the screen as the squeegee is drawn along the screen; and transferring an image defined by the screen onto the substrate via the printing medium.

28. The method of claim 27 wherein the step of shaping said screen includes the step of shaping said screen frame.

29. The method of claim 27 wherein the step of drawing the squeegee along the shaped screen includes varying the angle of the squeegee relative to the direction of travel of the squeegee.

30. The method of claim 29 wherein the angle is defined between the direction of travel of the squeegee and the length of the squeegee.

* * * * *